United States Patent [19]

Portinari et al.

[11] 4,105,485

[45] Aug. 8, 1978

[54] APPARATUS FOR IMPREGNATING STRANDED WIRES DURING STRANDING THEREOF

[75] Inventors: Antonio Portinari, Sesto San Giovanni (Milan); Piero Lavezzari, Desio (Milan), both of Italy

[73] Assignee: Industrie Pirelli Societa per Azioni, Milan, Italy

[21] Appl. No.: 734,004

[22] Filed: Oct. 20, 1976

Related U.S. Application Data

[62] Division of Ser. No. 569,806, Apr. 21, 1975, abandoned.

[30] Foreign Application Priority Data

May 28, 1974 [IT] Italy ..... 23225 A/74

[51] Int. Cl.[2] ..... H01B 13/30

[52] U.S. Cl. ..... 156/382; 156/48; 156/433

[58] Field of Search ..... 156/47, 48, 51, 56, 156/145, 146, 433, 434, 381, 382, 390, 391; 174/22 R, 23 R, 23 C; 118/405; 57/7, 162, 164

[56] References Cited

U.S. PATENT DOCUMENTS

| | | | |
|---|---|---|---|
| 3,811,406 | 5/1974 | Tomlinson | 156/390 |
| 3,876,487 | 4/1975 | Garrett et al. | 156/48 |
| 3,889,455 | 6/1975 | Portinari et al. | 57/7 |
| 3,972,304 | 8/1976 | Boucher | 118/405 |

*Primary Examiner*—David Klein
*Assistant Examiner*—William H. Thrower

[57] ABSTRACT

Apparatus for forming the stranded conductor portion of a fully-filled electric cable in which the components of the strand in side-by-side relation are fed through an inlet die at one end of a chamber in which a filling medium at a temperature at least 5° C above the dropping point temperature of the medium and under a pressure above atmospheric pressure is circulated in a direction opposite to the conductor feed direction. In the chamber, the components, preferably groups of conductors, are spread apart by a perforated disc through which they pass and are then twisted together at an outlet die at the opposite end of the chamber to form a strand with a coating of the medium and with the medium filling the spaces between components. From the outlet die the strand passes directly into a bath of the medium in a temperature controlled tank at atmospheric pressure but which maintains the medium at least 5° C above its dropping point temperature. From the tank, the strand is fed through a water cooled sizing tube which cools the medium below its dropping point temperature and shapes and smooths the medium on the exterior of the strand.

6 Claims, 1 Drawing Figure

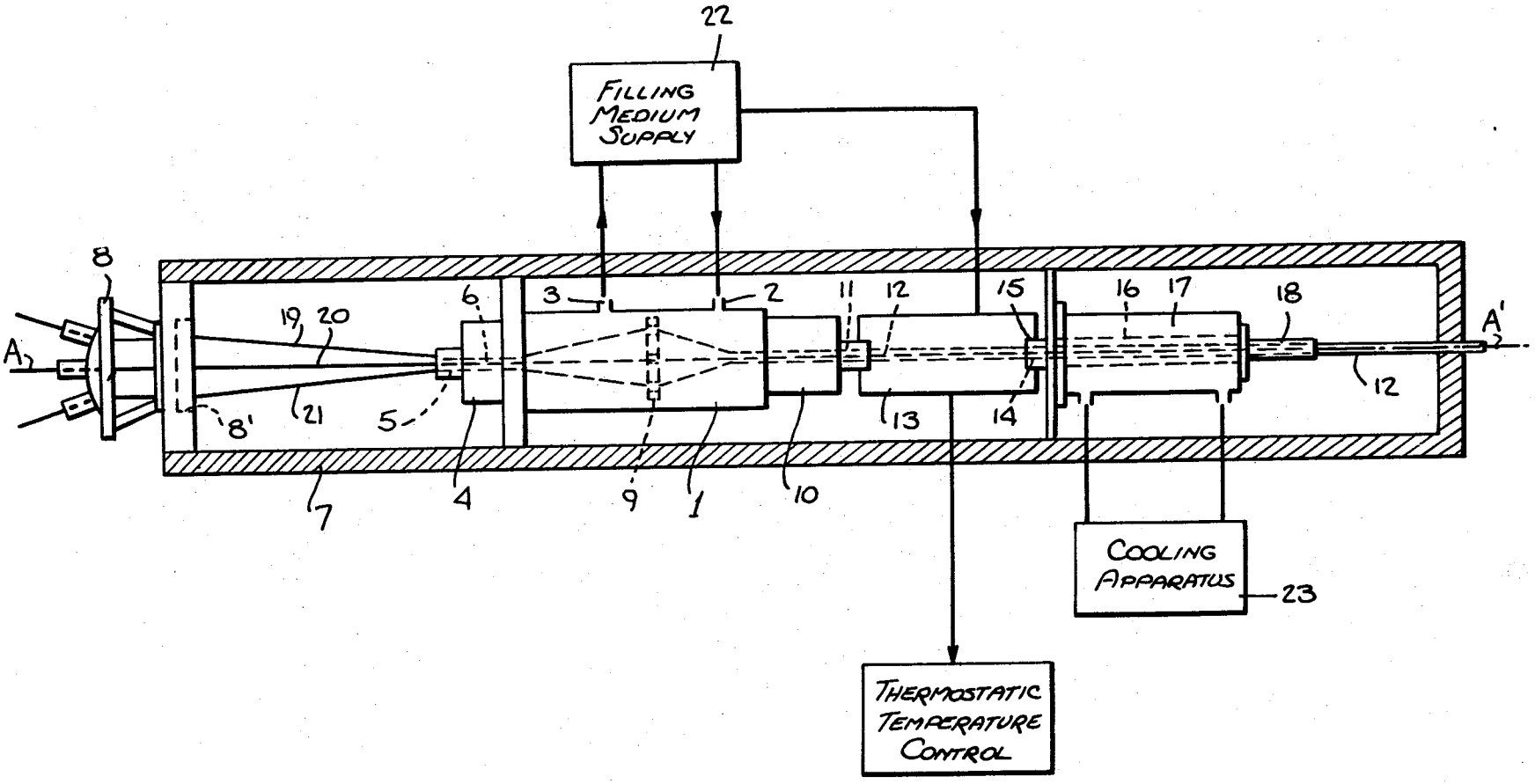
Filling Medium Supply
Cooling Apparatus
Thermostatic Temperature Control

APPARATUS FOR IMPREGNATING STRANDED WIRES DURING STRANDING THEREOF

This is a division of application Ser. No. 569,806 filed Apr. 21, 1975, now abandoned.

The present invention relates to the manufacture of electric cables, in particular, telecommunication cables of the type comprising a strand of several conductive elements, individually insulated, enclosed in an impermeable sheath and provided with a water-impermeable medium in the spaces existing in the strand and between it and the sheath. Cables of this kind are commonly known as "fully-filled cables" and will be designated by this expression in the present specification.

One known type of fully-filled cable comprises a strand of several conductive elements insulated with plastic material, for example, polyethylene. The "strand" is the bundle obtained by bringing together single conductors appropriately insulated, or the pairs, quads, trefoils, etc. constituted by stranding individually insulated wires. In the practice, two types of strands can be provided. One of them is called "concentric", because it is formed by several layers of conductive elements arranged concentrically, one layer on the other, about the axis of the strand, while the other is called "grouped", being formed by stranding bundles of conductive elements. Said bundles, in turn, can be formed concentrically or in groups. The present invention relates primarily to a process and the related apparatus for filling a grouped strand cable, having a large number of elements, with the water-impermeable medium.

It is known that the water-impermeable medium, introduced into the spaces existing inside the strand, and between the latter and the sheath, is mainly intended to prevent water infiltration along the cable and inside the sheath, in the event of a rupture. The filling medium is such that, at normal temperatures, it does not tend to migrate along the cable and, at the same time, permits the necessary relative sliding movements of the conductors required by the bending which takes place during the cable manufacture and installation.

In practice, said filling material consists of substances which are semi-solid at room temperature and which, because of their non-homogeneous nature, do not have, when the temperature increases, a melting point at a definite temperature but change their physical state within a limited temperature range, in general, a range of 15° C, passing gradually from the semi-solid to the liquid state. As is known, for these substances, reference is made to the so-called "dropping point ", which indicates the temperature at which the substance under consideration begins to soften, during heating, giving rise to drops. Said "dropping point" is determined by means of the American Society of Testing Materials D 566-42 Standard Test. The substancs which are used as a filling medium usually consist of microcrystalline petroleum waxes, mixtures of said waxes with oils, usually called "petroleum jelly", or of low molecular weight olefine polymers.

In the process for manufacturing said fully-filled cables, the operations related to the filling of the cable strand with the filling medium represents the most critical phase, since it is necessary to ensure that the filling medium fills as completely as possible all the hollow spaces existing between the conductive elements.

The known techniques used to carry out said operations for cables comprising groups with a large number of elements are various and comprise techniques for filling said spaces during the stranding of the groups or after the strand is formed. Such techniques are generally based on the carrying out of the impregnation by application of the liquid filling medium under pressure.

With respect to the filling techniques carried out during the stranding phase, it is the procedure to introduce the components of the strand separately, through an admission die provided with holes distributed about its axis and of a number corresponding to that of the components, into a liquid-tight, cylindrical chamber in which the liquid filling medium is circulated at a pressure higher than atmospheric pressure. Said medium is circulated in a direction opposite to that of the movement of the components, and as they continue their travel, said components exit from the liquid-tight cylindrical chamber through another die where they are assembled and simultaneously stranded. It is convenient to cool the two dies which define the ends of the liquid-tight, cylindrical chamber in order to at least prevent leaks of the filling medium through the holes of the dies.

Said techniques, although they are satisfactory from the point of view of the obtainable impregnation, have not, in general, a good versatility of use on cables of various sizes and formations because exact dimensions in respect of the elements to be stranded are required for the complicated dies which define the ends of the chamber under pressure.

With respect specifically to the filling techniques carried out on the already formed strand, the operations can be effected both on the stranding line and on the line of application of the final protection elements. In all cases, the apparatus is constituted by a cylindrical chamber in which the liquid filling medium is circulated and which is closed at its two ends by two cooled dies through which the strand to be impregnated passes. Said apparatus is more versatile than those previously described by virtue of the greater simplicity in substituting the dies sealing the chamber under pressure.

The hereinbefore described systems for filling the already formed strand can be easily applied to any type of strand, irrespective of its formation. In any event, it has been noted that they are quite suitable for the formation of strands constituted by a relatively small number of elements, with the result that the filling medium actually fills the whole strand. However, when the strand is made up of a large number of elements and, in particular, is of the grouped type, the results, in general, are not quite satisfactory.

The present invention has, as one object, to provide a grouped strand of a large number of elements and the complete filling of said strand with the filling medium under pressure without giving rise to the hereinbefore mentioned disadvantages and without employing particularly complicated equipment and working steps.

Accordingly, one object of the present invention is a process for the formation of a grouped strand constituted by components of elongated shape and indefinite length, and for the simultaneous filling of the interstices existing in said strand with a water-impermeable and electrically insulating filling medium, intended for the manufacture of an electric cable of the "fully-filled" type. Said process comprises the steps of introducing said components continuously and simultaneously into a liquid-tight, cylindrical chamber in which said filling medium is circulated in a direction opposite to the direction of passage of said components. The medium is at a temperature at least 5° C higher than its dropping point and at a pressure higher than the atmospheric pressure, and said components, in stranded condition, are removed from said chamber. The preferred embodiment of said process includes the following steps:

(1) introducing said components into said cylindrical chamber in side-by-side condition through an inlet die;

(2) separating said components from one another in said chamber;

(3) assembling said components and stranding them while removing the resulting strand from said chamber through an outlet die; and (4) passing said strand directly into said filling medium maintained at a temperature at least 5° C higher than its dropping point temperature and at atmospheric pressure.

Subsequently, said strand is brought, in a way known per se, to a temperature at least 5° C lower than the dropping point of said filling medium, with a simultaneous smoothing and levelling of the layer of filling medium impregnating said strand.

As previously suggested hereinbefore, the process of the invention is suitable for application to a strand comprising groups of a large number of elements where, in particular, a formation of more than 25 pairs is required for the groups. More specifically, the components of said groups are constituted by a number of pairs ranging between 50 and 100 pairs.

A further object of the present invention is to provide apparatus suitable for carrying out the above described process. Said apparatus comprises a liquid-tight, cylindrical chamber provided with inlet and outlet openings, through which said filling medium, at a temperature at least 5° C higher than its dropping point, is introduced and discharged at a pressure higher than the atmospheric pressure. Said apparatus also comprises:

(1) an inlet die which, if desired, is able to rotate about its own axis and which is coaxial with said chamber and provided with a through hole, in which said components are brought together and then introduced in side-by-side relation into said chamber;

(2) an outlet die, coaxial with the inlet die, provided with a through hole, at which said components are assembled and stranded and then removed from said chamber in the form of a strand;

(3) at least one circular spreading element, extending transversely in said chamber in an intermediate position between said inlet die and said outlet die, which, if desired, is able to rotate about its own axis, and which is coaxial with said dies, said element being provided with through holes distributed about said axis, each of said holes being intended for the passage of one component; and (4) at least one thermostatically controlled tank containing said filling medium at a temperature at least 5° C higher than its dropping point and at atmospheric pressure, said tank being associated, at one of its walls, with said cylindrical chamber and being provided, at said wall and at its opposite wall and below the level of the filling medium, with through holes which have a diameter approximately equal to that of the strand removed from said chamber, and which are coaxial with the through hole of said outlet die.

Said tank is directly connected in turn, in a way known per se, at the through hole present on its wall opposite to that associated with said chamber, to one end of a tube provided with means for maintaining it at a temperature at least 5° C lower than the dropping point of said filling medium, the other end of the tube being free and said tube having a diameter at the most 2 mm greater than the strand passing through it, so as to constitute the means for smoothing and levelling the layer of said filling medium impregnating said strand.

The hereinbefore described apparatus of the invention also comprises, associated with said liquid-tight, cylindrical chamber and at the inlet die, a container for collecting the filling medium which may flow from the hole of said die, said container being provided, at its wall opposite to the wall at said liquid-tight, cylindrical chamber, with a plate which, if desired, is able to rotate about its own axis and which is provided with through holes distributed about said axis, each of said holes being intended for the passage of one component.

The steps of the process of the invention for producing a strand formed by groups, in particular, those with a large number of elements, with the simultaneous filling of the interstices existing in said strand with the liquid filling medium under pressure, with the object of manufacturing a telecommunication electric cable of the fully-filled type, and the related apparatus will be more clearly apparent from the following detailed description of a preferred embodiment thereof, which description should be considered in conjunction with the single FIGURE in the accompanying drawing which illustrates, schematically and in plan view, apparatus of the invention.

The apparatus shown in the drawing provides a substantially rectilinear travel path along the line A–A' for the continuous passage of the components, particularly of groups, with a large number of elements, longitudinally. The liquid filling medium circulates under pressure in the liquid-tight, cylindrical chamber 1 in a direction opposite to the direction of passage of the components.

For this purpose, the cylindrical chamber 1 is provided with openings 2 and 3 for the inlet and the outlet, respectively, of the filling medium under pressure from the source 22. In particular, the filling medium is heated separately up to a temperature at least 5° C higher than its dropping point. Preferably, said filling medium is constituted by mixtures of Vaseline and paraffin, which are generally heated up to a temperature of 95°–100° C, the dropping point of the mixture being approximately at 90° C.

Said chamber 1 has, at one of its ends, an inlet die 4 which is provided with a through hole 5 through which the individual components, e.g., 19, 20, 21, enter the chamber 1, the components being simultaneously brought adjacent one to the other to form the assembly 6. The individual components, namely, the groups of a large number of elements, can come from normal joining dies, situated upstream of the apparatus but not illustrated in the drawing, or can be paid off from paying-off devices, also not illustrated, the components having been built up in a preceding separate operation. Before reaching the die 4, the groups pass through a container 7, co-axial with the cylindrical chamber 1, the purpose of which is to collect any liquid filling medium which may leak out of the inlet die 4.

More particularly, the individual groups, e.g., 19–21, etc., are introduced into the container 7 through a circular plate 8 provided with through holes distributed about the axis of the plate 8 which is co-axial with respect to the hole 5 in the inlet die 4. The number of the through holes corresponds to that of the groups intended to be introduced into the container 7.

A circular spreading element 9 is arranged inside the chamber 1 and extends tranversely thereof. The element 9 is also provided with through holes distributed about its own axis which is co-axial with respect to the cylindrical chamber 1. One group is caused to pass through each of said holes, obtaining in this way the mutual separation of the groups within the liquid filling medium under pressure in the chamber 1.

The plate 8 is provided with a seat 8' in which the die 4 and the element 9 may be placed in properly aligned positions, when the die 4 and the element 9 are removed from the cylindrical chamber 1 prior to commencement of the process and for the threading of the groups through the apparatus.

As they continue their travel within the cylindrical chamber 1, the individual groups, after their passage through the holes of the spreading element 9, exit from said chamber 1 through the outlet die 10 at the other end of the chamber 1. Said die 10 is provided with a through hole 11, through which the individual groups are assembled and stranded, forming therefore, a strand 12 which is totally impregnated with the liquid filling medium. Said hole 11 has a diameter of a size approximately the same as that of the strand 12 passing through it, and specifically, said diameter is, at the most, 2 mm. greater than that of the strand 12.

The cylindrical chamber 1 has relatively small dimensions. To carry out the filling operation with the medium filling the groups as described hereinbefore, it is sufficient for said chamber to have a length of the order of half a meter and a diameter of the order of 20 cm. Said dimensions are mainly dependent on the geometrical arrangement of the line and on the speed of the passage of the groups.

Associated with the cylindrical chamber 1, there is a thermostatically controlled tank 13 containing the same filling medium which is present in the cylindrical chamber 1 and at a temperature at least 5° C higher than its dropping point and at atmospheric pressure. Said tank 13, having a size approximately the same as that of the cylindrical chamber 1, is provided, at its wall adjacent to the outlet die 10, with a through hole, co-axial with respect to the hole 11 of the die 10, through which the strand 12 passes immediately from the outlet die 10 into the tank 13. The level of the filling medium present in said tank 13 is such that the hole of the wall adjacent to the outlet die 10 is completely below said level. Continuing its travel, the strand 12 passes through the tank 13 and penetrates, through a through hole 14 present in the wall 15 of said tank, into a tube 16 which is maintained at a temperature at least 5° C lower than the dropping point of said filling medium. The tube 16 may be situated in a container 17 where liquid from a source 23 and at said temperature is circulated. The tube 16 has its free end 18 open towards the outside of the container 7.

Both the hole 14 in the tank 13 and the tube 16, coaxial to each other, have a diameter whose size is approximately the same as that of the strand 12, in practice exceeding the diameter of the strand 12 by at most 2 mm.

The passage of the strand 12 in said tube 16, practically in contact with the wall of the tube 16, having a temperature at least 5° C lower than the dropping point of the filling medium, causes a temperature drop of the medium with its consequent quick conversion from the liquid state to the semi-solid state. The tube 16 has a length approximately corresponding to that of the tank 13, so that the strand 12, issuing from the tube 16, through the free end 18, has a completely semi-solid filling, without a loss of the filling medium from said strand 12. Moreover, the strand 12 during its passage through the apparatus is uniformly covered and all recesses are filled with the filling medium, so that, as it leaves the tube 16 it has an outer surface of filling medium which is perfectly levelled and smoothed and totally surrounding the outer surfaces of the groups.

In conclusion, in spite of its large size, a strand 12 results which is completely filled both internally and externally with the filling medium, and is ready for the subsequent processing steps for the manufacture of a fully-filled telecommunication cable.

The process for the formation of the grouped strand with the simultaneous filling of the latter by the filling medium, which forms the object of the present invention, can be carried out by stranding the groups by a rotating paying-off system or by a rotating taking-up system.

When it is wished to form the strand by rotary take-up, the apparatus of the invention has a construction such that the circular plate 8 present on the container 7, the inlet die 4, the spreading element 9 and the outlet die 10 are stationary. Alternatively, when it is wished to form the strand by rotary unwinding, then the outlet die 10 is stationary, whereas all of the other elements 4, 8 and 9 will be rotatable and will rotate. For this purpose, in such apparatus, the spreading element 9, the inlet die 4 and the circular plate 8 may be connected together by means of a plurality of shafts, which, in turn, are connected by means of a toothed belt to the main driving shaft which causes the rotation, upstream of the apparatus, of the cage carrying the bobbins, each of which has a group wound thereon.

The hereinbefore described process, as already stated, is particularly suitable for manufacturing a strand with groups of a large number of elements in which a total filling with the filling medium is ensured. Also, said process is carried out with simple working phases and without resorting to a particularly complicated apparatus. More particularly, the advantages deriving from the process forming the object of the present invention and from the adoption of the relative apparatus are the following:

(1) the groups are introduced, in side-by-side relation into the cylindrical chamber 1, containing the liquid filling medium under pressure, through the hole 5 of the inlet die 4. Therefore, leaking of the filling medium is substantially reduced with respect to the leaks which would occur if the groups were introduced, as is normally done, individually into the chamber 1 through a die provided with a number of holes corresponding in number to that of the groups. This permits operation even when the die is not cooled;

(2) the use of the inlet die 4 provided with a single through hole makes simpler and more expeditious the replacement operations necessary to adapt the apparatus, from time to time, to the diameter of the groups intended to be stranded and filled with the filling medium. To obtain such adjustment of the hole sizes of an inlet die having a plurality of holes, such holes are normally provided with replaceable cylindrical elements, axially divided into two halves and having a diameter approximately corresponding to that of the groups intended to pass through them, in order to prevent as much as possible the outflowing of the filling medium under pressure present in the cylindrical chamber 1. The practical advantage of adopting an inlet die 4 provided with a single through hole with respect to the commonly used inlet die having several holes is therefore evident;

(3) the mutual separation of the groups inside the cylindrical chamber by means of their passage through the spreading element 9 has the result that the groups individually come into contact with the liquid filling medium under pressure, so that a total impregnation of each group is obtained before assembling and stranding the groups at the outlet die 10.

(4) the existence of the thermostatically controlled tank 13, containing the liquid filling medium at atmospheric pressure, in an intermediate position between the cylindrical chamber 1 and the cooling tube 16, places the tube 16 in contact with a zone in which the filling medium is not under pressure. This makes less critical the dimension of the cooling tube 16 in relation to the dimension of the strand 12. In fact, if the tank 13 were not provided, it would be necessary to use a tube 16 having a diameter very close to that of the strand, or alternatively, to adopt a cooling system, associated with said tube 16, capable of a cooling rate much higher than the simple circulation of water, in order to reduce the leaks of the filling medium.

Although preferred embodiments of the present invention have been described and illustrated, it will be understood by those skilled in the art that various modifications may be made without departing from the principles of the invention.

What is claimed is:

1. In apparatus for manufacturing a grouped strand for a fully-filled electric cable, said strand comprising a plurality of electrically conductive components of elongated shape stranded together with the spaces between said components filled with, and the exterior of said strand coated by, a water-impermeable and electrically insulating filling medium having a predetermined dropping point temperature, said apparatus comprising:

a chamber having an inlet opening and an outlet opening spaced from said inlet opening for circulating said medium under a pressure above atmospheric pressure and at a temperature at least 5° C above said dropping point temperature through said chamber and having an inlet die at one portion of said chamber and an outlet die at another portion of said chamber spaced from said one portion, each said die having an opening therethrough of a size for closely receiving, while permitting the passage therethrough of, all said components in abutting relation and the opening of said outlet die being aligned with the opening of said outlet die and said chamber being substantially liquid-tight except for the opening in each die, and said inlet opening and said outlet opening;

a spreading element mounted in said chamber, between said inlet die and outlet die, and extending transversely of a line between said opening of said inlet die and said opening of said outlet die and intermediate and being spaced from both said inlet die and said outlet die, said spreading element having a plurality of apertures therein spaced from each other and from said line for individually receiving said components and permitting the passage of a said component through an aperture, each of said apertures being spaced from the others of said apertures by a distance greater than the distance between said abutting components as they pass through said inlet die to cause said components to be forced apart after they leave said inlet die; so that after passage through said apertures, the entire outer surface of each component is in contact with said filling medium for impregnation thereby means connected to said inlet opening and said outlet opening and supplying said medium to said inlet opening under pressure above atmospheric pressure and at a temperature at least 5° C above said dropping point temperature and withdrawing said medium through said outlet opening;

a tank receiving said medium at atmospheric pressure and at a temperature at least 5° C above said dropping point temperature, said tank having a first wall at said outlet die with an opening therethrough aligned with said opening in said outlet die and having a second wall spaced from said first wall with an opening therethrough aligned with said opening in said first wall, said tank having the level of the medium therein above said opening in said first wall and said opening in said second wall;

a sizing tube for said medium extending from said second wall and aligned with opening in said second wall, said tube having an inner size substantially equal to but larger than the cross-section of said strand; and means for cooling said tube.

2. Apparatus as set forth in claim 1 wherein said inlet die, said spreading element and said outlet die are non-rotatable.

3. Apparatus as set forth in claim 1 wherein said inlet die and said spreading element are rotatable and said outlet die is non-rotatable.

4. Apparatus as set forth in claim 1 wherein said chamber is cylindrical and said opening in said inlet die and said opening in said outlet die are co-axial with said cylinder and said line is co-incident with the axis of said cylinder.

5. Apparatus as set forth in claim 1 further comprising thermostatically controlled means for maintaining said medium in said tank at a temperature at least 5° C above said dropping point temperature.

6. Apparatus as set forth in claim 1 further comprising a container adjacent said inlet die for receiving said medium which may leak from said inlet die and having a wall spaced from said inlet die and a plate mounted on said last-mentioned wall, said plate having a plurality of spaced apertures therein for the passage of said components therethrough, each aperture receiving one said component.

* * * * *

UNITED STATES PATENT AND TRADEMARK OFFICE

CERTIFICATE OF CORRECTION

PATENT NO. : 4,105,485

DATED : August 8, 1978

INVENTOR(S) : Antonio Portinari and Piero Lavezzari

It is certified that error appears in the above-identified patent and that said Letters Patent are hereby corrected as shown below:

Col. 8, line 37 "opening" should read "said opening"

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*